US007267473B2

(12) United States Patent
Kreutzer

(10) Patent No.: US 7,267,473 B2
(45) Date of Patent: Sep. 11, 2007

(54) TRANSFER SYSTEM FOR COLORING AGENTS

(75) Inventor: Charles Kreutzer, Springfield, IL (US)

(73) Assignee: Solomon Colors, Inc., Springfield, IL (US)

( * ) Notice: Subject to any disclaimer, the term of this patent is extended or adjusted under 35 U.S.C. 154(b) by 96 days.

(21) Appl. No.: 10/650,491

(22) Filed: Aug. 28, 2003

(65) Prior Publication Data

US 2005/0180256 A1 Aug. 18, 2005

(51) Int. Cl.
*B01F 3/08* (2006.01)
*B01F 15/02* (2006.01)

(52) U.S. Cl. ..... 366/10; 366/40; 366/182.4

(58) Field of Classification Search ..... 366/173.2, 366/167.1, 183.2, 190, 40, 10, 3, 34, 30, 366/182.1, 182.4; 239/594, 592
See application file for complete search history.

(56) References Cited

U.S. PATENT DOCUMENTS 1,531,354 A * 3/1925 Stackpole ..... 239/433
1,933,543 A * 11/1933 Anderson ..... 366/10
2,618,576 A * 11/1952 Brown et al. ..... 366/3
2,776,284 A * 1/1957 Hood ..... 544/201
2,868,516 A * 1/1959 Moseley ..... 366/167.1
3,212,759 A * 10/1965 Brown ..... 366/11
3,236,248 A * 2/1966 Ray ..... 134/58 R
3,243,128 A * 3/1966 Tight ..... 241/65
3,325,974 A * 6/1967 Griffin, III et al. ..... 96/162
3,415,257 A * 12/1968 Wellman ..... 134/98.1
4,030,513 A * 6/1977 McKenzie ..... 134/167 R
4,077,612 A * 3/1978 Ricciardi ..... 366/102
4,390,284 A * 6/1983 Hyde et al. ..... 366/165.5
4,685,810 A * 8/1987 Sakuichi et al. ..... 366/182.1
4,803,955 A * 2/1989 Gonsalves ..... 119/71
4,830,505 A * 5/1989 Dunton et al. ..... 366/136
5,263,225 A * 11/1993 Winters ..... 15/353
5,348,058 A * 9/1994 Ruhl ..... 141/1
5,427,126 A * 6/1995 Carney et al. ..... 134/98.1
5,609,417 A * 3/1997 Otte ..... 366/137
5,666,987 A * 9/1997 Combs ..... 137/1
6,361,201 B1 * 3/2002 Russell et al. ..... 366/144

* cited by examiner

*Primary Examiner*—Tony G Soohoo
(74) *Attorney, Agent, or Firm*—Polsinelli Shalton Flanigan Suelthaus PC

(57) ABSTRACT

A system for transferring coloring agents for concrete to a ready mix truck or the like, includes a tank for receiving coloring agents. The tank includes lines for supplying it with water and a pump for transferring the coloring agents to the ready mix truck through a discharge line.

10 Claims, 4 Drawing Sheets

TRANSFER SYSTEM FOR COLORING AGENTS

TECHNICAL FIELD

The present invention relates to a system and a method for use with concrete machinery. In particular, the invention is directed to systems and apparatus for transferring liquid colors, coloring agents, colorants and other pigments, to ready mix concrete trucks safely, efficiently, and with minimal material waste.

BACKGROUND OF THE INVENTION

Concrete has long been a staple in the construction industry. As concrete technology increases, more uses are found for it, including coloring concrete while it is being mixed. By coloring concrete in the mixing stage, its coloration is permanent and does not require painting, that must be done periodically, and typically does not wear uniformly.

Previous attempts to color concrete have involved laborers with buckets of coloration agent climbing ladders to pour these agents into the ready mix trucks. As these laborers had to climb to the top of the trucks with heavy buckets, the actual amount of coloration agent reaching the ready mix tank in the truck was inaccurate, so the color content was not uniform and varied from load to load. Also, workers climbing to a truck is labor intensive and thus expensive, and spillage typically occurs, resulting in wasted material. Moreover, workers climbing on ladders or stairs with heavy buckets of materials resulted in injuries, sometimes quite serious, from slips, falls and the like, whereby substantial man hours and job time was lost, increasing construction costs.

SUMMARY OF THE INVENTION

The present invention provides a system, apparatus and method that allows for precisely measured amounts of coloration agent(s) to be transferred directly into the load in ready mix concrete trucks. As a result, concrete color is uniform between all of the loads required for a concrete job. This transfer is effective and efficient, as it requires a worker to control the apparatus, eliminating the need for laborers with buckets and climbing stairs, ramps and ladders, thus, eliminating on the job injuries associated with these actions. Moreover, the system and apparatus is easily cleanable, and efficient, as it allows for new coloring agents to be entered into the apparatus immediately after the previous coloring agent has been rinsed therefrom.

An embodiment of the invention is directed to a method for transferring a composition to a load in a mixing chamber. This method includes, providing a tank positioned proximate to ground level, obtaining a composition in the tank to be mixed into the load in the mixing chamber; and transferring the composition to the mixing chamber. The composition typically includes colors, coloring agents, colorants, pigments and the like (collectively "colors") suitable for coloring materials such as concrete. These colors are typically in liquid form. The mixing chamber is typically in a ready mix truck, where concrete is being prepared.

Another embodiment is directed to an apparatus for transferring compositions, typically liquid colors for concrete or the like, between it and a mixing chamber, for example, in a ready mix truck or the like. The apparatus includes a tank, a transferring apparatus in communication with the tank; and a cover, removably attachable with respect to the tank. The cover is moveable between a first position, where the tank is closed and a second position, where the tank is open to the ambient environment.

BRIEF DESCRIPTION OF THE DRAWINGS

Attention is now directed to the attached drawings, wherein like reference numerals indicate corresponding or like components. In the drawings.

DETAILED DESCRIPTION OF THE DRAWINGS

Figure 1:
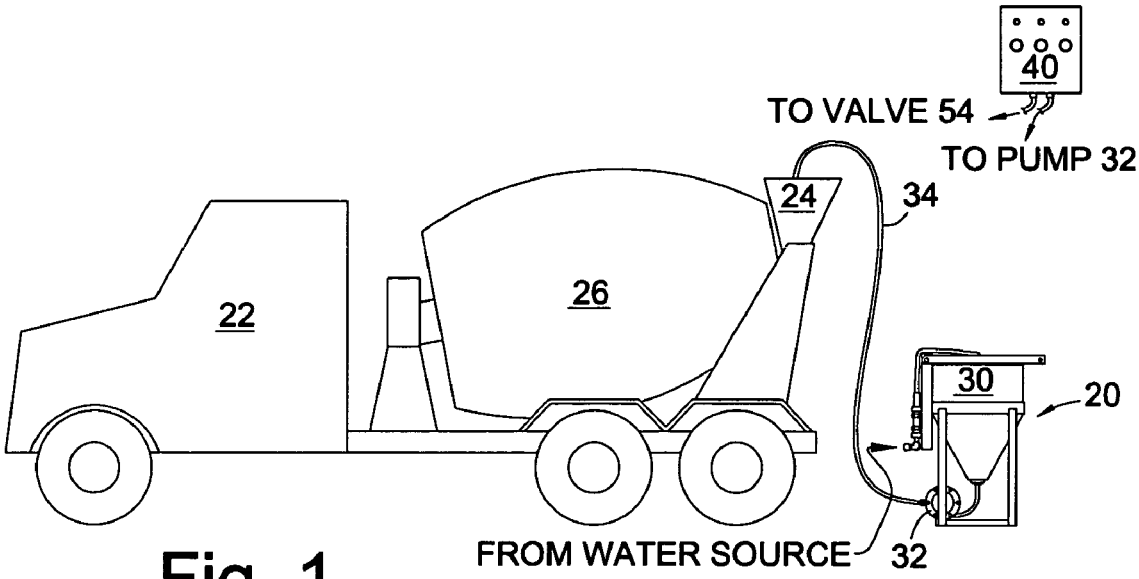
FIG. 1 shows the apparatus in use in accordance with an embodiment of the invention.

FIG. 1 shows the apparatus 20 of the present invention in an exemplary operation. Here, colors, coloring agents, colorants, pigments (collectively "colors") and the like for concrete and the like are typically in liquid form, in the apparatus 20. The colors may include additives if desired. From the apparatus 20, the colors are loaded into trucks, typically ready mix cement trucks 22, into a hopper 24 of the mixing chamber 26. Specifically, these colors are provided to a tank 30 of the apparatus 20, and enter into the hopper 24, as pumped by a pump 32 over a discharge line 34.

The pump 32 includes an internal valve (not shown) that controls the flow of material, received from a connector line 36 from the tank 30, to the discharge line 34. There is also a water line 38 leading into the tank 30, for adding water to the tank 30, as well as rinsing it. Both the water flow into the tank 30 and the pump 32 are controlled by a Programmable Logic Controller (PLC), typically with a microprocessor or other computerized controller, in a control box 40.

Figure 2:
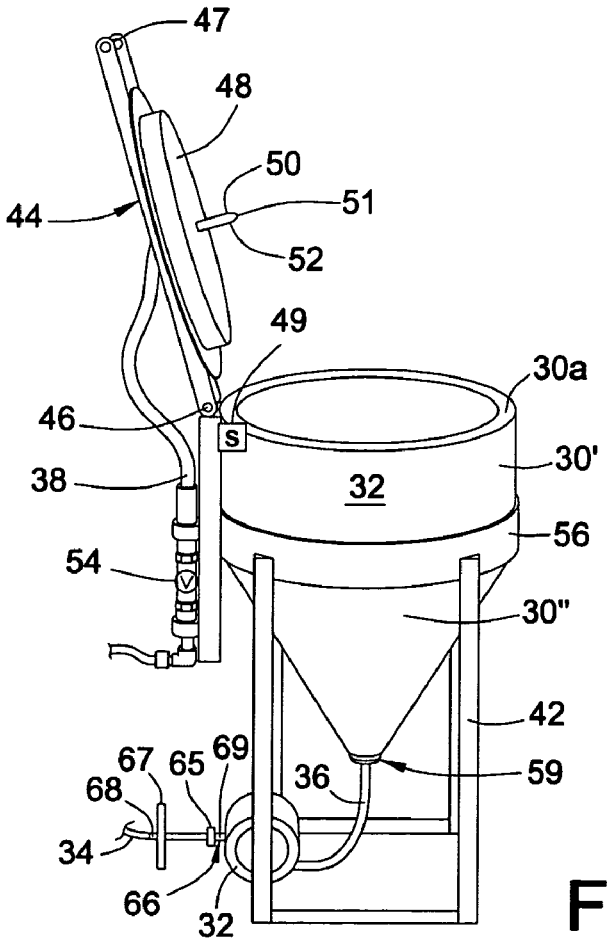
FIG. 2 is a perspective view of the apparatus of FIG. 1 with the cover in the open position.
Figure 3:
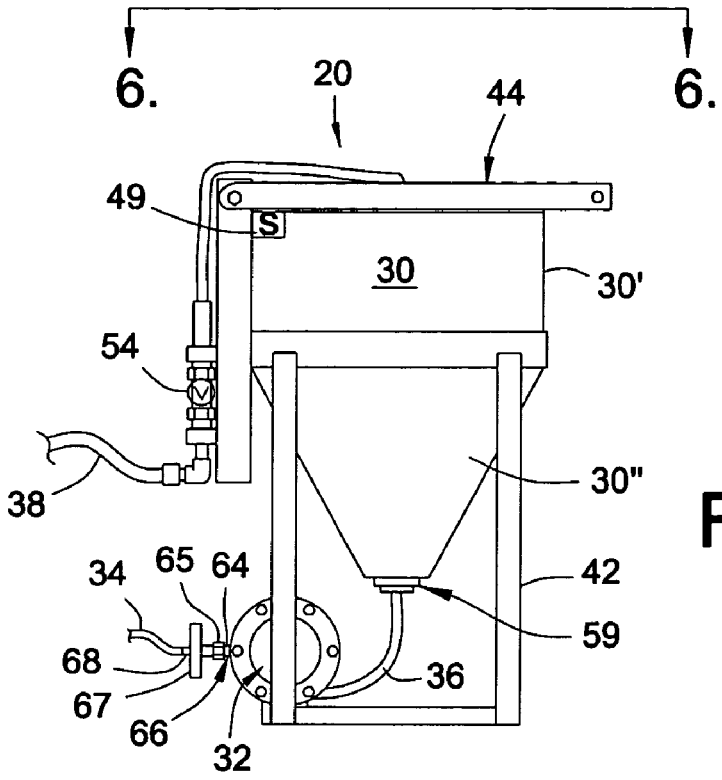
FIG. 3 is a side view of the apparatus of FIG. 1 with the cover in a closed position.

Turning also to FIGS. 2 and 3, the tank 30 rests in a support 42, that is typically placed at ground level. A cover 44 for fitting over the tank 30, mounts to the support 42, typically in a hinged manner, with a pin 46 or the like. The cover 44 typically includes a handle 47, allowing it to be lifted by a user when access to the interior of the tank 30 is desired, for example, when material is being added to the tank 30. The cover 44 also includes an outwardly protruding platform 48 that is of a diameter just slightly less than the inner diameter of the tank 30, at its rim 30*a* to form a snug fit with the cover 44 in the tank 30.

There is also a cover interlock sensor (S) 49 proximate to the cover 44, typically on the tank 30, that senses whether or not the cover 44 is closed over the tank 30. This sensor 49 is coupled to the PLC or controller in the control box 40, so as to allow for rinsing of the tank 30 (and also typically, downstream components of the apparatus 20) only when the cover 44 is completely closed over the tank 30.

A nozzle or nipple 50 is typically mounted in and protrudes from the cover 44. The nozzle 50 is coupled to the water line 38 and typically includes openings 51 at its end 52 that allow for water to reach various locations in the tank 30, typically by spraying the water. This allows for adding or preloading water into the tank 30.

Water can be added to the tank 30, prior to the colors being placed into the tank 30, to wet the tank 30. This wetting minimizes adherence of the colors to the walls of the tank 30. The water from this wetting also fills the connector line 36, such that the pump 32 and discharge line 34 are lubricated, allowing for a rapid discharge and minimal adherence to the discharge line 34. Water can also be added to the tank 30 with the colors, for mixing with the colors, and in some instances, surrounding the colors such that the colors are inhibited from directly contacting the tank 30. Water can also be added to the tank 30 for rinsing of the tank 30, as detailed below. The water line 38 and nozzle 50 are also suitable for transporting fluids, such as gases and liquids other than water if desired.

The water line 38 typically includes a valve (V) 54 or other water flow controller along it, to control water flow to the nozzle 50. The valve (V) 54 is typically electrically connected to the control box 40.

The tank 30, is a vessel or other similar structure, that typically includes a first portion 30' of a cylindrical section and a second portion 30" of a conical section. Typically, the first portion 30' includes the rim 30*a* and is oriented, such that it is above the second portion 30". The conical shape of the second portion 30" allows the tank 30 to seat securely in the support 42, in a ring portion 56.

Figure 4:
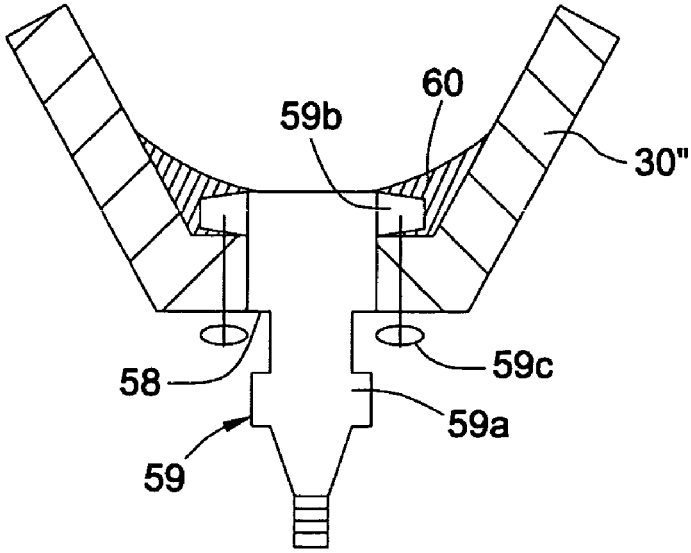
FIG. 4 is a cross sectional view of the conical portion of the tank at the opening showing the discharge fitting therein, of the apparatus of FIG. 1.

Turning also to FIG. 4, the tank 30 terminates in an opening 58, which receives a discharge fitting 59. This discharge fitting 59 is formed of a bulkhead fitting 59*a*, having an end for connecting to the connector line 36, and a reducer 59*b* (reducer ring). The discharge fitting 59 typically attaches to the tank 30 at the conical portion 30" by bolts 59*c*, or other mechanical fasteners. A ring 60 of an epoxy filler surrounds the discharge fitting 59, and is angled downward (in the direction of the opening 58), to cause fluid flow into the discharge fitting 59. This epoxy filler ring 60 prevents the formation of any pockets, that could trap and retain colors after the rinse cycle, detailed below. For example, discharge member 59 could be of a 1.5 inch bulkhead fitting with a 0.75 inch reducer, in order to cover the opening 58.

The tank 30 is typically a unitary member, made of materials such as hard plastic, stainless steel or the like, that is chemical and water-resistant. The cover 44 is typically of aluminum, stainless steel or chemical or water resistant material.

The pump 32 includes an air intake port 64, typically controlled (turned on and off) by a valve 65, along an arm 66 that extends from the body of the pump 32. This port 64 is an opening and also typically includes a threaded attachment to receive a hose (not shown) from an air source (not shown) and/or other fittings. A regulator 67 is also coupled to the valve 65, and serves to adjust air pressure in the discharge line 34, to adjust discharge speed of the material therefrom. The regulator 67 terminates in a quick connect member 68, to which the discharge line 34 attaches. This quick connect member 68 is such that the discharge line 34 or other line can be coupled to the regulator 67 quickly and absent tools. The air driven pump 32 provides sufficient force to transfer the colors or pigments to heights of approximately 10-25 feet, along the length (for example, approximately 40 feet) of the discharge line 34.

The pump 32 is electrically connected to the control box 40. The pump 32 can be any pump that provides sufficient pumping force to transfer the colors or pigments to heights of approximately 10-25 feet and lengths of approximately 10-60 feet, and may be a diaphragm pump. For example, one suitable pump is a NDB-20 diaphragm pump, available from Yamada Corporation, Tokyo, Japan (Yamada America, West Chicago, Ill.).

Figure 5A:
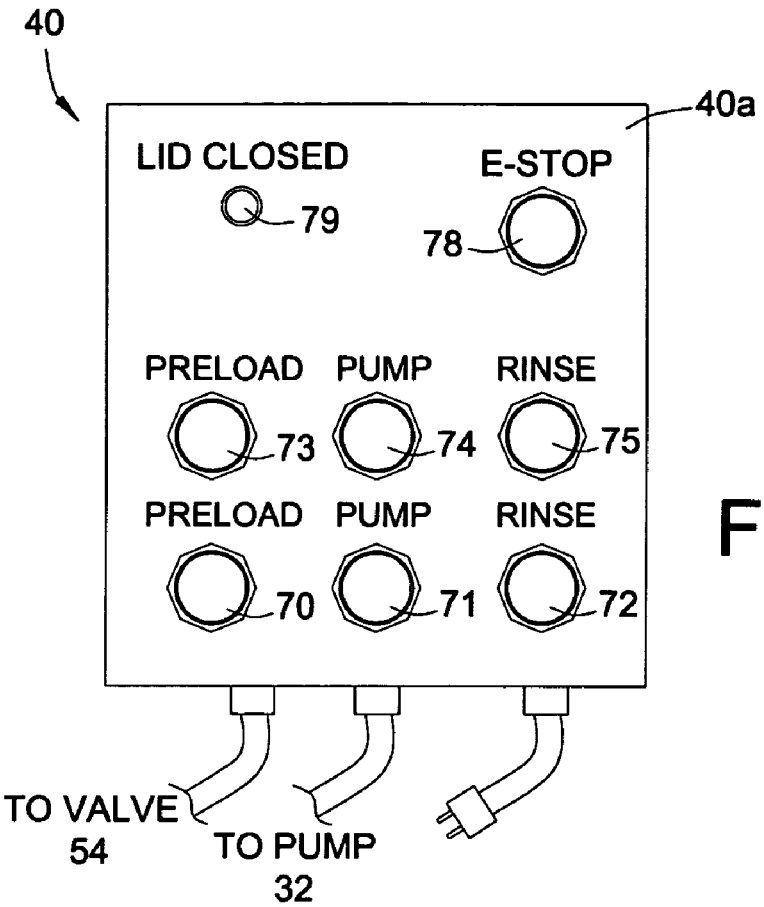
FIG. 5A is a front view of the control box of the apparatus of FIG. 1.

Turning also to FIG. 5A, the control box 40 is typically a programmable logic control (PLC) device, that is controlled by microprocessor or the like. The cover 40*a* of the box 40 includes buttons 70-72, that when depressed, activate the operational modes (cycles) of: PRELOAD 70 (where, for example, water flow is started to initially wet the tank 30), PUMP 71 (where, for example, the transfer of the colors or pigments from the tank 30 to the pump 32 and through the discharge line 34 is made) and RINSE 72 (where, for example, the final rinse to clean the tank 30 and pump 32 for the next color or pigment), all preprogrammed into the PLC and the microprocessor of the control box 40.

There are also lights 73-75, corresponding to these buttons 70-72 to indicate the performance (current state of) the operational modes of PRELOAD 73, PUMP 74 and RINSE 75. There is also a stop (emergency stop) or E-STOP button 78, to stop the apparatus 20 if necessary. There is also an interlock light 79, coupled to the interlock sensor 49, indicating that the cover 44 is closed on the tank 30, thus preventing an operator of the apparatus 20 from being sprayed during the prewet and rinse cycles of the apparatus 20.

Figure 5B:
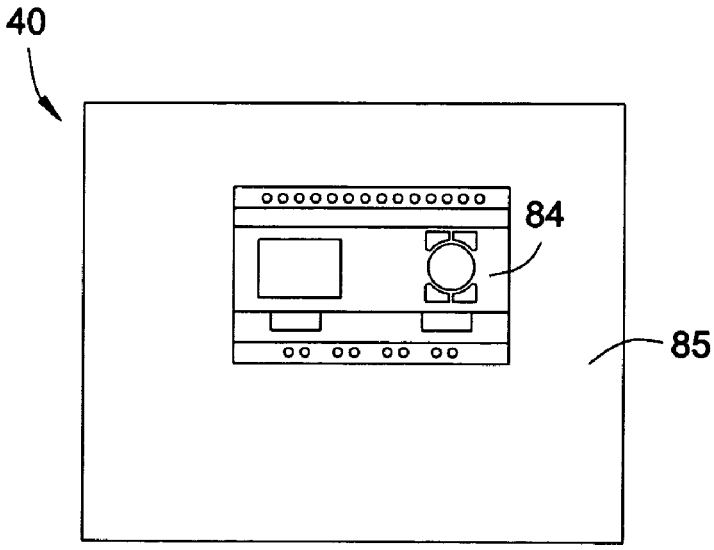
FIG. 5B is a front view inside the control box of the apparatus of FIG. 1.

The control box 40 is suitable for mounting, such as to a wall, other stable structure, or the like. The control box 40 can also be operated by a programmable timer 84, on its interior wall 85, as shown in FIG. 5B.

One embodiment of the apparatus, for example, includes an approximately 17 gallon tank, of dimensions approximately 40 inches in length with an approximately 18 inch inner diameter and 20 inch outer diameter in its first or cylindrical portion. The support is approximately 40 inches high, and adapted to rest on the ground. The pump is a ¾ inch transfer pump. The pump 32 is of dimensions of approximately 13×10×13 inches and is configured for air entry, regulated to approximately 60-80 PSI, 15 CFM through a ¼ inch quick connect port. The water line 38 is configured to accommodate 40 PSI of continuous pressure and accommodates a ¾ inch hose connection for accommodating a ¾ inch discharge line. The apparatus 20 runs on an electrical system of 110 Volts. The tank 30, support 42 and cover 44 weigh approximately 90 pounds.

Figure 6A:
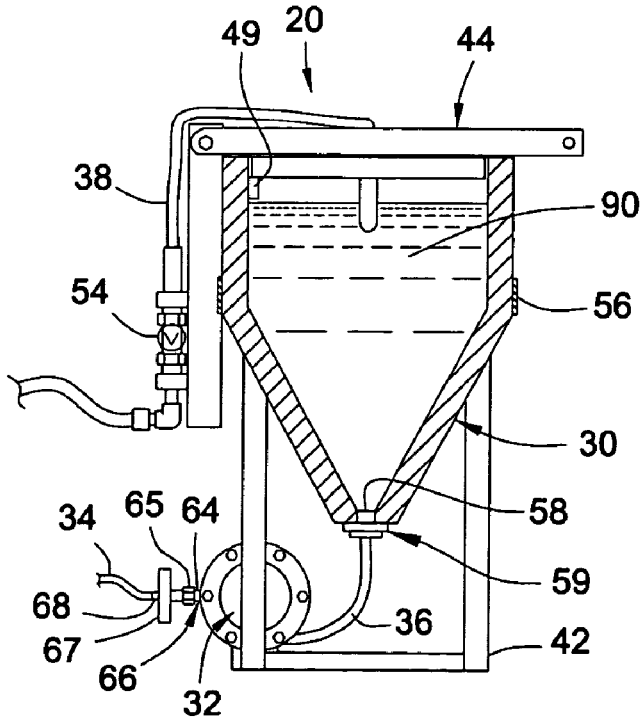
FIGS. 6A and 6B are cross sectional views of the apparatus taken along line 6-6 of FIG. 3 showing operational modes.
Figure 6B:
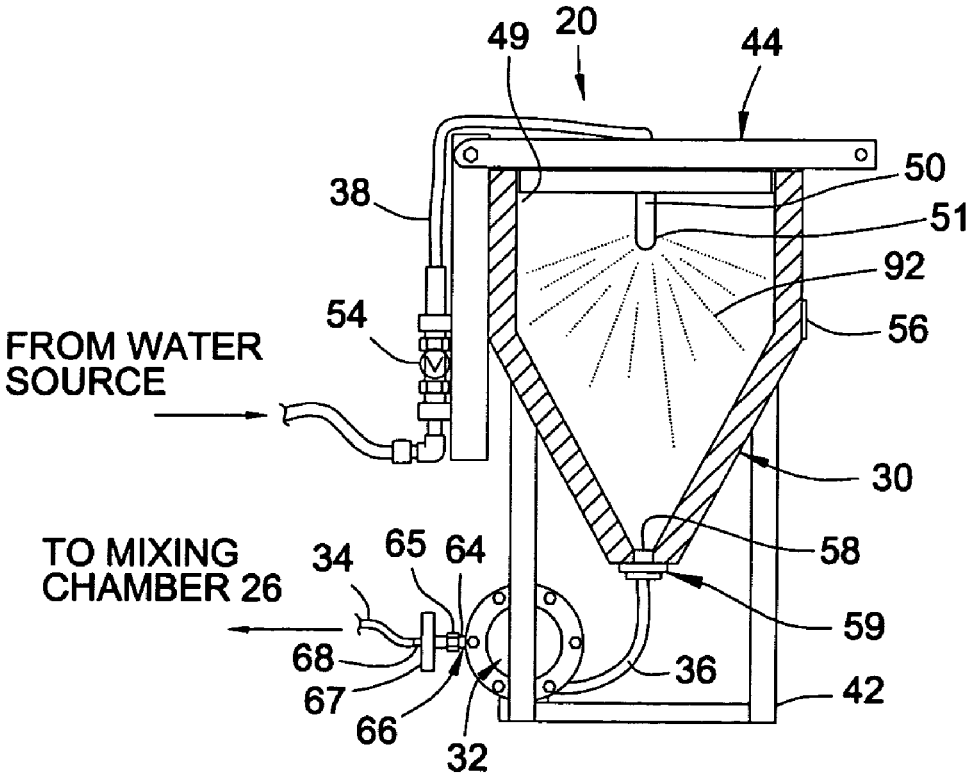

An exemplary operation (process) of the apparatus 20 will now be described, as shown in FIGS. 6A and 6B. Reference will also be made to FIGS. 1-5B, shown and described above.

Initially, the apparatus 20 is at a location proximate the ready mix truck 22 to be loaded, with the discharge line 34 in the hopper 24 of the truck 22. With the cover 44 typically closed, the PRE-LOAD button 70 is pressed and an amount of water is pumped from the water line 38, through the nipple 50 to wet the inner walls of the tank 30, and precharge the line 36 and pump 32, as part of a preload cycle. The PRELOAD light 73 is now illuminated. This preload cycle is a timed sequence, with the PRELOAD light 73 turning off automatically at completion of this cycle.

The cover 44 is then opened and the color or pigment is poured into the tank 30. This pouring is typically done manually by workers with buckets. However, the tank 30 is at a height at which the workers can reach easily, and pour the contents, for examples, colors with or without additives, of their buckets, containers, or other holders, into the tank 30, without additional ladders or other elevation devices. This height is typically proximate to the level of the ground.

The cover 44 is then closed, and the colors 90 in the tank 30, as shown in FIG. 6A, can now be transferred to, for example, the ready mix truck 22, as shown in FIG. 1. The PUMP button 71 is now pressed (activated) and pumping by the pump 32 begins, transferring the colors in the tank 30 to the truck 22 over the discharge line 34. The PUMP light 74 is now illuminated as the PRELOAD light 73 has now shut down (as detailed above).

When pumping is complete, as the tank 30 is empty, the RINSE button 72 is pressed (activated), and the corresponding RINSE light 75 illuminates. All other lights (PRELOAD 73 and PUMP 74) are off. Rinse water, as well as all water for the apparatus 20, is typically obtained from a municipal or other source under pressure. The water, obtained via the water line 38, exits through the nozzle 50 in a spray 92, into the tank 30, as shown in FIG. 6B. It is then pumped through the pump 32 and discharge line 34, into the truck 22, rinsing the pump 32 and discharge line 34. The apparatus 20 is now ready for its next color.

Thus, there has been shown and described apparatus and processes receiving and transferring materials, such as colors, coloring agents, colorants, pigments and the like, to mixing chambers, for concrete and the like, typically associated with ready mix trucks. It is apparent to those skilled in the art, however, that many changes, variations, modifications, and other uses and applications for the above described embodiments are possible, and also such changes, variations, modifications, and other uses and applications which do not depart from the spirit and scope of the invention are deemed to be covered by the invention, which is limited only by the claims which follow.

What is claimed is:

1. An apparatus for transferring fluidic compositions for coloring concrete comprising:

a tank including an interior defined by walls;

a fluid transferring apparatus in communication with the tank for withdrawing a concrete coloring fluid from the interior of the tank;

the fluid transferring apparatus comprising a pump and a discharge line extending from the pump for transferring the concrete coloring fluid from the tank to a supply of concrete;

a cover, removably attachable with respect to the tank, the cover moveable between a first position, where the interior of the tank is closed to the ambient environment and a second position, where the interior of the tank is open to the ambient environment to receive the concrete coloring fluid;

a system for rinsing the tank with an aqueous fluid, including, an aqueous fluid intake port connected to a source of the aqueous fluid; and, a dispenser in communication with the aqueous fluid intake port and configured for providing the aqueous fluid to the interior of the tank for contacting the walls of the interior of the tank, the dispenser coupled to the cover; and, a controller for operating the fluid transferring apparatus and the system for rinsing the tank, the controller in electrical communication with the aqueous fluid intake port and the pump, and the controller comprising a preload mode for directing the aqueous fluid intake port to direct the aqueous fluid to enter the interior of the tank, a pump mode for directing the pump to transfer the concrete coloring fluid from the tank through the discharge line, and a rinse mode for directing the aqueous fluid intake port to direct the aqueous fluid to enter the interior of the tank.

2. The apparatus of claim 1, wherein the dispenser includes a nozzle in communication with an aqueous fluid transport line.

3. The apparatus of claim 2, wherein the aqueous fluid transport line is configured for coupling with a source of pressurized water.

4. The apparatus of claim 2, wherein the aqueous fluid transport line is coupled with a source of pressurized water.

5. The apparatus of claim 1, wherein die pump includes a diaphragm pump.

6. The apparatus of claim 1, additionally comprising, a support member for receiving and holding the tank proximate to the ground level.

7. The apparatus of claim 1, additionally comprising: the discharge line extending from the pump, the pump including a valve.

8. The apparatus of claim 7, additionally comprising: a conduit extending from the tank to the pump.

9. The apparatus of claim 8, wherein the tank includes a first cylindrical portion, for communication with the cover, and a second conical portion, for communication with the conduit.

10. The apparatus of claim 1, wherein the cover is attached to the tank by a hinge.

* * * * *